US011462356B2

(12) United States Patent
Muramoto et al.

(10) Patent No.: US 11,462,356 B2
(45) Date of Patent: Oct. 4, 2022

(54) INTERNAL COMBUSTION ENGINE USE IGNITION DEVICE

(71) Applicant: Mitsubishi Electric Corporation, Tokyo (JP)

(72) Inventors: Yuichi Muramoto, Tokyo (JP); Naoki Kataoka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/288,074

(22) PCT Filed: Dec. 18, 2018

(86) PCT No.: PCT/JP2018/046479
§ 371 (c)(1),
(2) Date: Apr. 23, 2021

(87) PCT Pub. No.: WO2020/129141
PCT Pub. Date: Jun. 25, 2020

(65) Prior Publication Data

US 2021/0383964 A1 Dec. 9, 2021

(51) Int. Cl.
*H01F 38/12* (2006.01)
*F02P 3/04* (2006.01)

(52) U.S. Cl.
CPC ..... *H01F 38/12* (2013.01); *F02P 3/04* (2013.01)

(58) Field of Classification Search
CPC ..... H01F 38/12; F02P 3/04
See application file for complete search history.

(56) References Cited

U.S. PATENT DOCUMENTS 9,399,979 B2 7/2016 Heise et al.
2015/0219062 A1 8/2015 Pawlak et al.
(Continued)

FOREIGN PATENT DOCUMENTS

JP 2013-113122 A 6/2013
JP 2014-218995 A 11/2014
(Continued)

OTHER PUBLICATIONS

International Search Report of PCT/JP2018/046479 dated Mar. 19, 2019 [PCT/ISA/210].
(Continued)

*Primary Examiner* — Jacob M Amick
*Assistant Examiner* — Charles J Brauch
(74) *Attorney, Agent, or Firm* — Sughrue Mion, PLLC; Richard C. Turner

(57) ABSTRACT

In an internal combustion engine use ignition device includes an ignition coil which has a primary coil and a secondary coil, that are wound around a core, a superimpose circuit which generates an output energy, that is to be superimposed with respect to a secondary current, produced in the secondary coil by the primary coil, a first switch element which is connected to the primary coil and turns on or off of a current to the primary coil, a second switch element which is connected to the superimpose circuit, and stops an operation in a case where the first switch element is turned on, and performs an operation in a case where the first switch element is turned off, and a common input terminal which receives a first driving signal for driving the first switch element and a second driving signal for driving the second switch element.

7 Claims, 10 Drawing Sheets

(56) References Cited

U.S. PATENT DOCUMENTS

| | | | |
|---|---|---|---|
| 2015/0219063 | A1 | 8/2015 | Pawlak et al. |
| 2016/0047352 | A1 | 2/2016 | Nakayama et al. |
| 2016/0245255 | A1 | 8/2016 | Sekine |

FOREIGN PATENT DOCUMENTS

| | | | | | |
|---|---|---|---|---|---|
| JP | 2015-529774 | A | | 10/2015 | |
| JP | 2016-156276 | A | | 9/2016 | |
| JP | 2016156276 | A | * | 9/2016 | ..... F02P 9/007 |
| WO | 2017/006487 | A1 | | 1/2017 | |
| WO | WO-2017006487 | A1 | * | 1/2017 | ..... F02P 15/08 |

OTHER PUBLICATIONS

Office Action dated Jan. 18, 2022 from the Japanese Patent Office in JP Application No. 2020-560669.

Communication dated Jun. 9, 2022 from the China National Intellectual Property Administration in Chinese Application No. 201880100000.5.

* cited by examiner

INTERNAL COMBUSTION ENGINE USE IGNITION DEVICE

CROSS REFERENCE TO RELATED APPLICATIONS

This application is a National Stage of International Application No. PCT/JP2018/046479 filed on Dec. 18, 2018.

FIELD OF THE INVENTION

The present application relates to an internal combustion engine use ignition device.

BACKGROUND OF THE INVENTION

Internal combustion engine use ignition devices are provided with a primary coil whose high voltage side terminal of one end is connected to a direct current power source, and a secondary coil which is wound around by secondary winding turns, the number of which is in a predetermined winding turns ratio, with respect to the primary coil; and are the ones in which a high secondary voltage is generated in the secondary coil by the increase and decrease of a primary current which flows into the primary coil, and energy is supplied to an ignition plug that is attached to one end of this secondary coil, and a spark discharge is generated.

An existing internal combustion engine use ignition device (hereinafter, referred to as an ignition device, for short) plays a role to convert a low voltage of a direct current power source into a high voltage, so that sparks can fly outward in an ignition plug. As for the constitution of the ignition device, there is provided with a core in the center, which has a large permeability, and a primary coil and a secondary coil are wound around the surroundings of the core. Flowing a current through the primary coil (main primary coil) magnetizes the core, and magnetic energy is stored there, and a magnetic field is generated in the circumference of the core. Through the shutting off of a temporary current by switching, the magnetic field changes and a self induction action occurs. Thereby, a voltage of 300 to 500 V is generated in the primary coil. In the situation here, a voltage of 25 to 30 kV is generated, at the same time, also at the secondary coil side, with which the primary coil shares a magnetic circuit and a magnetic flux.

Ignition devices are proposed which employ various methods for superimposing output energy (current) additionally on this secondary side output. That is to say, the internal combustion engine which is made to operate in a lean state or in a high EGR (Exhaust Gas Recirculation) state is studied for the improvement of fuel efficiency in the internal combustion engine. However, because the air-fuel mixture of the internal combustion engine which is made to operate in the lean state or in the high EGR state does not present a good ignitability, a higher energy state, especially a higher electric current state, is required in the ignition device.

For example, in Patent Document 1, there is disclosed a method for an ignition device which is provided with two primary coils and one secondary coil, with respect to a core, where a switch element (main IC) which performs on and off control of a current is provided in one of the primary coils (main primary coil), and a switch element (sub IC) which performs on and off control of a current is provided in the other of the primary coils (sub primary coil). When the main IC is turned on, a primary current (main primary current) flows through the main primary coil, and thereby, a secondary current is generated in the secondary coil. After that, the sub IC is turned on and the sub primary coil is made to receive the energy of a primary current (sub primary current), and thereby, a current which is to be superimposed on a secondary current of the secondary coil is generated.

Further, in Patent Document 2, there is disclosed a method in which a secondary superimposing current is generated in a secondary coil, whereby a switch element is turned on after a secondary current is generated, and a magnetic flux by applied electric current with a reverse direction is generated in a primary coil, with a step up transformer circuit.

Further, in Patent Document 3, there is disclosed a method in which a secondary superimposing current is generated in a secondary coil, whereby a switch element is turned on after a secondary current is generated, and energy is input in the secondary coil, with a step up transformer circuit.

CITATION LIST

Patent Literature

Patent Document 1: U.S. Pat. No. 9,399,979 B2
Patent Document 2: JP 2014-218995, A
Patent Document 3: JP 2015-529774, A

SUMMARY OF THE INVENTION

Technical Problem

In the ignition devices for superimposing output energy (current), which are disclosed in the Patent Documents 1 to 3, there is provided with an additional circuit for superimposing a current, with respect to an existing ignition device, and then, a driving signal for driving the additional circuit appropriately is needed, other than a signal for the main IC driving use. For the reason above, a terminal for inputting a driving signal is needed in the additional circuit, and there arises a problem that a larger size and increased cost of the ignition device is caused.

Further, also in an engine control unit (Electronic Control Unit), a circuit configuration for outputting a driving signal is needed in the additional circuit, and an increase in the cost is caused.

The present application is made in order to solve the above mentioned subject, and aims at attaining a reduced size and decreased cost in the ignition device.

Solution to Problem

An internal combustion engine use ignition device according to the present application, includes:

an ignition coil which has a primary coil and a secondary coil, which are wound around a core, a superimpose circuit which generates an output energy, which is to be superimposed with respect to a secondary current, produced in the secondary coil by the primary coil, a first switch element which is connected to the primary coil and turns on or off of a current to the primary coil, a second switch element which is connected to the superimpose circuit and turns on or off of a current to the superimpose circuit, in response to an operation of the first switch element, and a common input terminal which receives a first driving signal for driving the first switch element and a second driving signal for driving the second switch element, wherein an operation of the second switch element is stopped during an operation of the first switch element, and an operation of the first switch element is stopped during an operation of the second switch element.

Advantageous Effects of Invention

According to the ignition device of the present application, the number of signal lines can be reduced by one, since an input terminal which receives a first driving signal and an input terminal which receives a second driving signal can be offered by using a common input terminal. Further, the number of output terminals from the ECU can be reduced by the number of cylinders. For the reason above, a reduced size and decreased cost can be achieved in the ignition device.

DESCRIPTION OF EMBODIMENTS

Figure 1:
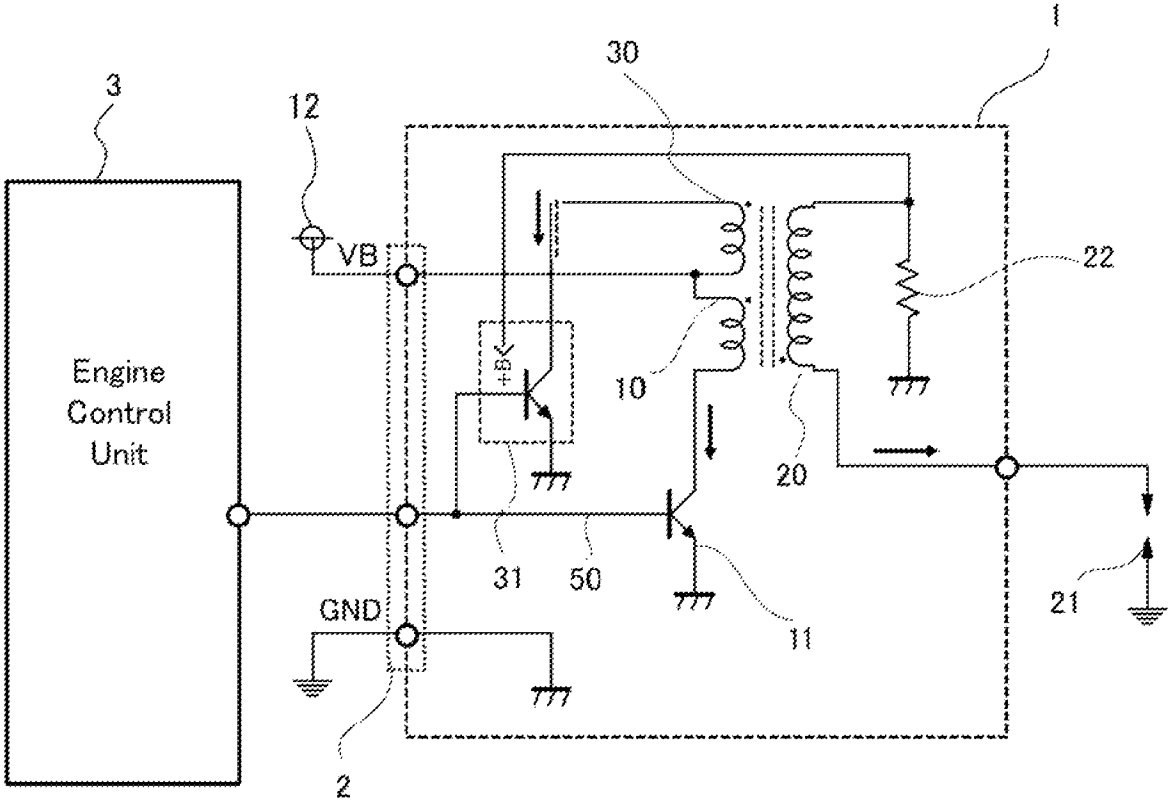
FIG. 1 is a circuit diagram of the internal combustion engine use ignition device in accordance with Embodiment 1 of the present application.

Hereinafter, explanation will be made about embodiments of the internal combustion engine use ignition device according to the present application, with reference to drawings. It is to be noted that, the same or corresponding parts in each of the figures are designated by the same reference numerals and overlapping explanation is omitted.

Embodiment 1

Figure 2:
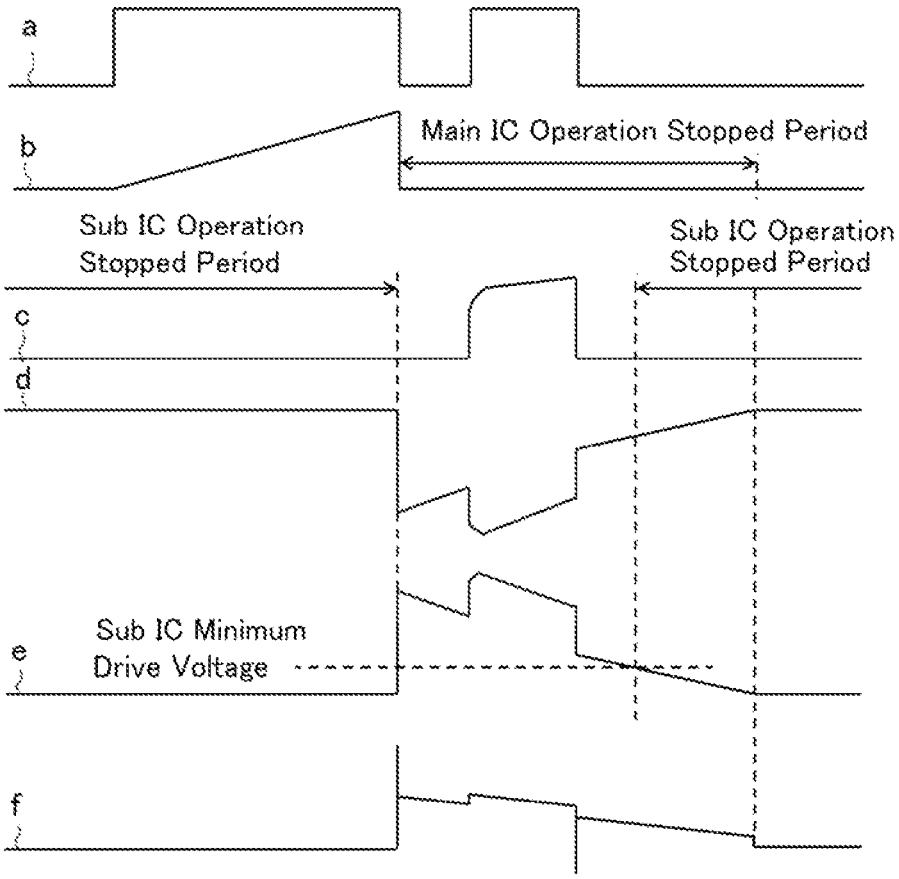
FIG. 2 is a drawing which shows the operational waveforms of the circuit diagram of FIG. 1.

FIG. 1 is a circuit diagram which shows an internal combustion engine use ignition device, in accordance with Embodiment 1 of the present application. Further, FIG. 2 is a drawing for showing operational waveforms in the circuit diagram of FIG. 1, where the circuit is under basic conditions.

In the internal combustion engine use ignition device in accordance with Embodiment 1, as is shown in FIG. 1, the primary coil of an ignition coil is divided, in the middle point, into a main primary coil 10 and a sub primary coil 30, and a current from a power source 12 is supplied to the middle point through an ignition device input connector 2. Further, the switching between on and off for the electrical connection of the main primary coil 10 is performed with a main IC 11 (switch element) which is connected to the main primary coil 10.

When the main IC 11 is turned on, a current will flow into the main primary coil 10, and a magnetic flux by applied electric current is produced in a positive direction. By shutting off the current at a predetermined timing, from the state in which electric power is supplied, a shut off magnetic flux is produced in a reverse direction. As a result, the magnetic field changes, and a self induction action occurs, and a voltage is generated in the main primary coil 10. At this time, a voltage is generated also on the secondary coil 20 side, with which the main primary coil shares a magnetic circuit and a magnetic flux.

Further, the switching between on and off for the electrical connection to the sub primary coil 30 is performed with a sub IC 31 (switch element), which is connected to the sub primary coil 30. Energy is superimposed with respect to the secondary current, which is produced in the secondary coil 20, when a current flows into the sub primary coil 30.

The main IC 11, which is a semiconductor switch element and is connected to the main primary coil 10, has functions to detect a voltage between its own c and e terminals (a collector and an emitter), and to stop its own operation at the time when a voltage is generated between the c and e terminals. The sub IC 31 is connected to the sub primary coil 30. Then, the drive of the main IC 11 is based on a driving signal which is sent from the engine control unit 3, through a signal line 50 and an ignition device input connector 2. Further, the sub IC 31 is similarly also driven based on a driving signal which is sent from the engine control unit 3, through the signal line 50 and the ignition device input connector 2.

As for the secondary coil 20 of an ignition coil, one end is connected to the ignition plug 21, and the other end is connected to the secondary current pathway resistance 22. The secondary coil generates a discharge energy, by coupling magnetically with the main primary coil 10 and the sub primary coil 30. The main primary coil 10 and the sub primary coil 30 are connected to the same ignition coil power source 12. The main primary coil 10 is wound around with wire so as to have a reverse polarity with respect to the secondary coil 20, when a current is made to flow from the ignition coil power source 12. The sub primary coil 30 is wound around with wire so as to have the same polarity with respect to the secondary coil 20, when a current is made to flow from the ignition coil power source 12. That is to say, the main primary coil 10 and the sub primary coil 30 are wound around with wire, so as to have a reverse polarity each other, when viewed from the ignition coil power source 12.

One end of the secondary current pathway resistance 22 is connected to the ground (GND), and the other end is connected to the low voltage side of the secondary coil 20 and the power source (+B) terminal of the sub IC 31. For the reason above, only during the period when a secondary current is generated, electric power is supplied to the sub IC 31, so as to establish a state in which the sub IC 31 can operate. That is to say, the sub IC 31 stops its operation during the operation of the main IC 11, and the main IC 11 stops its operation during the operation of the sub IC 31.

Next, operations of this circuit will be explained based on FIG. 2. The waveform a, which is shown in FIG. 2, represents a common driving signal to the main IC 11 and the sub IC 31; the waveform b represents a current which flows through the main primary coil 10 (main primary coil current); the waveform c represents a current which flows through the sub primary coil 30 (sub primary coil current); the waveform d represents a secondary current (=a secondary current by the main coil+a superimposed current by the sub coil); the waveform e represents a power source voltage of the sub IC 31; and the waveform f represents a voltage between the c and e terminals of the main IC 11 (between the collector and the emitter).

Following the first time on and off of the common driving signal of the main IC 11 and the sub IC 31, power feeding to the main primary coil 10 or its shut off is carried out. When electric power is supplied to the main primary coil 10, the application of a voltage is not performed to the power source (+B) terminal of the sub IC 31, and then, electric power is not supplied to the sub primary coil 30.

When the current to the main primary coil 10 is shut off, the mutual induction action is induced, and thereby, a large voltage of a negative side is generated in the secondary coil 20 (not shown in FIG. 2). Owing to this voltage, a discharge is generated between the gaps of the ignition plug 21, and a negative current flows into the secondary coil 20 (the arrow direction of FIG. 1 represents a positive direction).

Further, when power feeding by applied electric current is carried out to the secondary coil 20, a positive voltage on the basis of the GND is generated between the both terminals of the secondary current pathway resistance 22, and the voltage is applied to the power source terminal (+B) of the sub IC 31. Next, following the second time on and off of the common driving signal of the main IC 11 and the sub IC 31, power feeding to the sub primary coil 30 or its shut off is carried out, and a superimposed current is generated on the secondary current, only during the period when power feeding by applied electric current is carried out to the sub primary coil 30. In the case where a secondary current is generated, a voltage is generated between the c and e terminals (the collector and the emitter) of the main IC 11, and thereby, the main IC 11 stops its own operation and power feeding is not carried out to the main primary coil 10.

As described above, the operation of the sub IC 31 is stopped during the operation period of the main IC 11, without performing the application of a voltage to the power source (+B) terminal of the sub IC 31. Further, using the function to stop its own operation by detecting a voltage between the c and e terminals (the collector and the emitter) of the main IC 11, the operation of the main IC 11 is stopped, during the operation period of the sub IC 31. In those situations, even though a driving signal which is common to both of the main IC 11 and the sub IC 31 (common driving signal of the main IC 11 & the sub IC 31) is input, the main primary coil 10 and the sub primary coil 30 can operate each other, without cancelling the mutual energy during their operations.

Further, since the driving signals of the main IC 11 and the driving signal of the sub IC 31 can be both input with one signal line 50, the number of signal lines can be reduced by one, rather than inputting a driving signal into both of the main IC 11 and the sub IC 31 individually. The terminals of the ignition circuit input connector 2 can be decreased in number, and a reduced size and cost reduction can be performed in the ignition circuit 1.

Further, also in the engine control unit 3 which performs signal output to the ignition circuit 1, the number of signal lines for outputting can be reduced by one, in each of the cylinders, and then, a reduced size and cost reduction can be performed.

It is to be noted that, in this Embodiment 1, the sub primary coil 30 corresponds to a circuit which can superimpose the output energy with respect to the secondary current, which is produced in a secondary coil.

Embodiment 2

Figure 3:
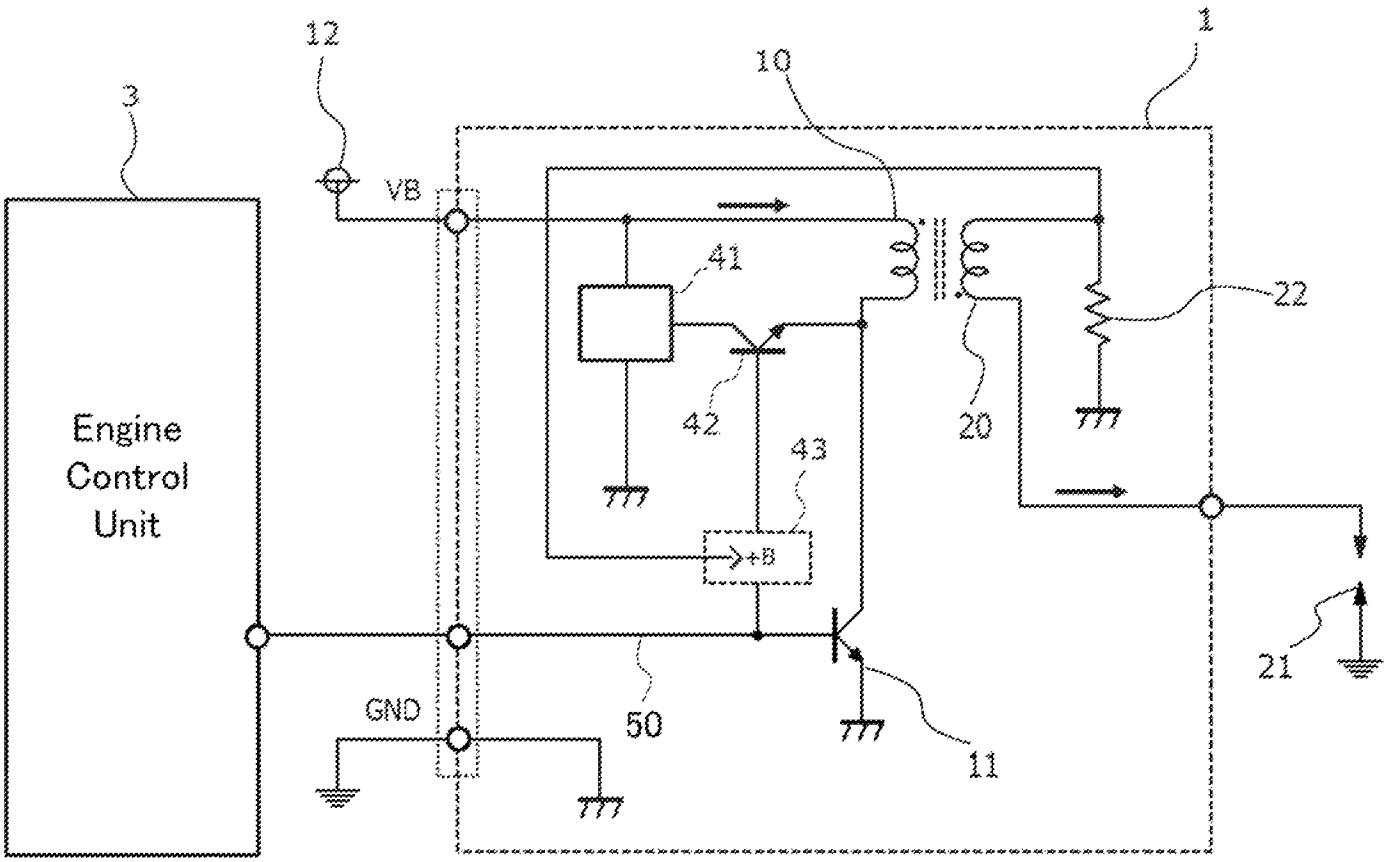
FIG. 3 is a circuit diagram of the internal combustion engine use ignition device in accordance with Embodiment 2 of the present application.
Figure 4:
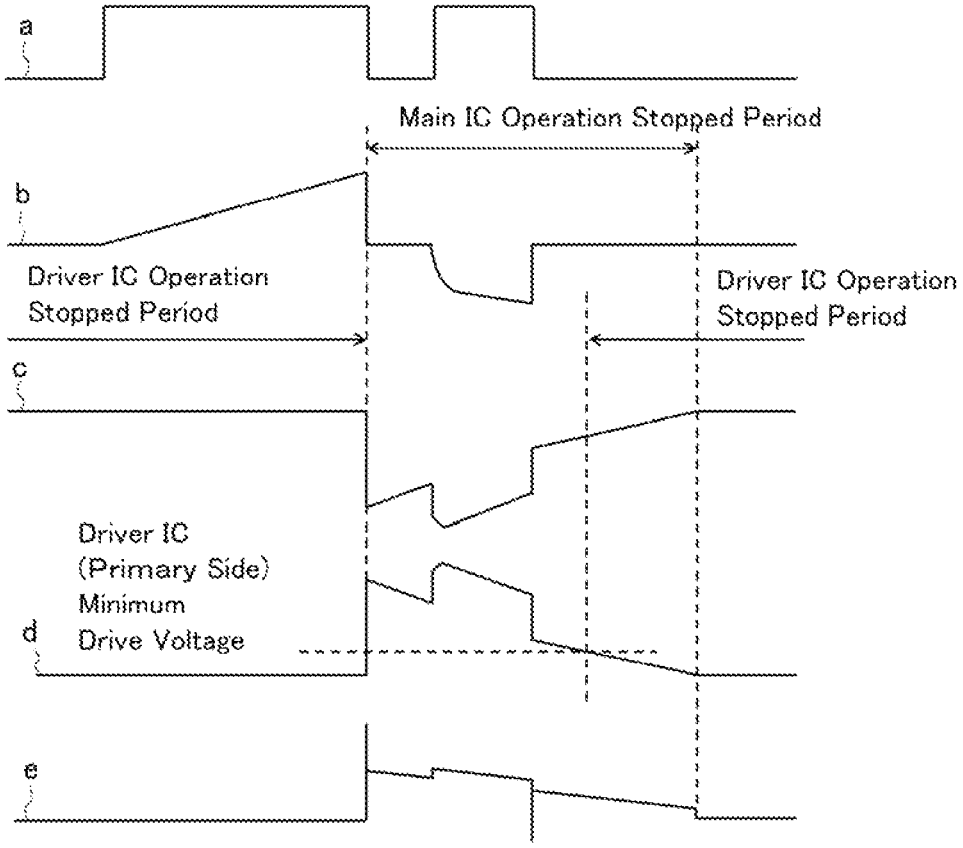
FIG. 4 is a drawing which shows the operational waveforms of the circuit diagram of FIG. 3.

FIG. 3 is a circuit diagram which shows an internal combustion engine use ignition device, in accordance with Embodiment 2 of the present application. Further, FIG. 4 is a drawing for showing operational waveforms in the circuit diagram of FIG. 3, where the circuit is under basic conditions.

As shown in FIG. 3, the internal combustion engine use ignition device in accordance with Embodiment 2 includes a main primary coil 10; a main IC 11 which is connected to the main primary coil 10, and has functions to switch between the power feeding to the main primary coil 10 and its shut off, and to detect between its own c and e terminals (the collector and the emitter), and to stop its own operation at the time when a voltage is generated between the c and e terminals; a primary side step up power source 41 which performs a step up operation using a VB voltage (reference voltage); a primary side switch element 42 which is disposed at the collector terminal of the main IC 11, in parallel with the main primary coil 10, and switches the voltage application to the main primary coil 10, from the primary side step up power source 41; a primary side driver IC 43 which performs a signal input to the primary side switch element 42; and a secondary coil 20 which is connected to the ignition plug 21 at one end, and is connected to the secondary current pathway resistance 22 at the other end, and generates a discharge energy by coupling magnetically with the main primary coil 10.

One end of the secondary current pathway resistance 22 is connected with the ground (GND), and the other end is connected to the low voltage side of the secondary coil 20 and the power source (+B) terminal of the primary side driver IC 43. For the reason above, only during the period when a secondary current is generated, electric power is supplied to the driver IC (primary side) 43, so as to establish a state in which the driver IC can operate.

Next, operations of this circuit will be explained based on FIG. 4. The waveform a, which is shown in FIG. 4, represents a common driving signal to the main IC 11 and the primary side driver IC 43; the waveform b represents a current which flows into the main primary coil 10 (main primary coil current); the waveform c represents a secondary current (a current which flows into the secondary coil 20); the waveform d represents a power source voltage of the driver IC (primary side) 43; and the waveform e represents a voltage between the c and e terminals (the collector and the emitter) of the main IC 11.

Following the first time on and off of the common driving signal to the main IC 11 and the primary side driver IC 43, power feeding to the main primary coil 10 or its shut off is carried out. In that case, since the application of a voltage is not performed to the power source (+B) terminal of the primary side driver IC 43, the primary side switch element 42 is not turned on, and power feeding to the main primary coil 10 is not carried out.

The current to the main primary coil 10 is shut off. Owing to the mutual induction action, a large voltage of a negative side is generated in the secondary coil 20 (not shown in FIG. 4). With this voltage, a discharge is generated between the gaps of the ignition plug 21, and a negative current flows into the secondary coil 20 (the arrow direction of FIG. 3 represents a positive direction).

Further, when power feeding by applied electric current is carried out to the secondary coil 20, a positive voltage on the basis of the GND is generated between the both terminals of the secondary current pathway resistance 22, and the voltage is applied to the power source (+B) terminal of the primary side driver IC 43. Next, following the second time on and off of the common driving signal of the main IC 11 & the primary side driver IC 43, a current with a reverse direction is power fed or shut off to the main primary coil 10. Only during the period when power feeding of a reverse directional current is carried out to the main primary coil 10, a superimposed current is generated on the secondary current. In the case where a secondary current is generated, a voltage is generated between the c and e terminals (the collector and the emitter) of the main IC 11, and thereby, the main IC 11 stops its own operation and power feeding to the main primary coil 10 is not carried out.

As described above, during the operation period of the main IC 11, the operation of the driver IC (primary side) 43 is stopped, without applying a voltage to the power source terminal (+B) of the primary side driver IC 43. Further, during the operation period of the primary driver IC 43, the operation of the main IC 11 is stopped, using the function to stop its own operation by detecting a voltage between the c and e terminals (the collector and the emitter) of the main IC 11. As a result, even though a driving signal in common (common driving signal of the main IC 11 & the primary side driver IC 43) is input to both of the main IC 11 and the primary side driver IC 43, a current with a positive direction starts to flow into the main primary coil 10, at the on-timing of the main IC 11, and the ignition operation can be performed normally.

Further, since the driving signal of the main IC 11 and the driving signal of the primary side driver IC 43 can be both input with one signal line 50, the number of signal lines can be reduced by one, rather than inputting a driving signal into both of the main IC 11 and the primary side driver IC 43 individually. The terminals of the ignition circuit input connector 2 can be reduced in number, and the reduced size and cost reduction can be performed in the ignition circuit 1. Further, also in the engine control unit 3 which performs signal output to the ignition circuit 1, the number of signal lines for outputting can be reduced by one, in each of the cylinders, and then, a reduced size and cost reduction can be performed.

Embodiment 3

Figure 5:
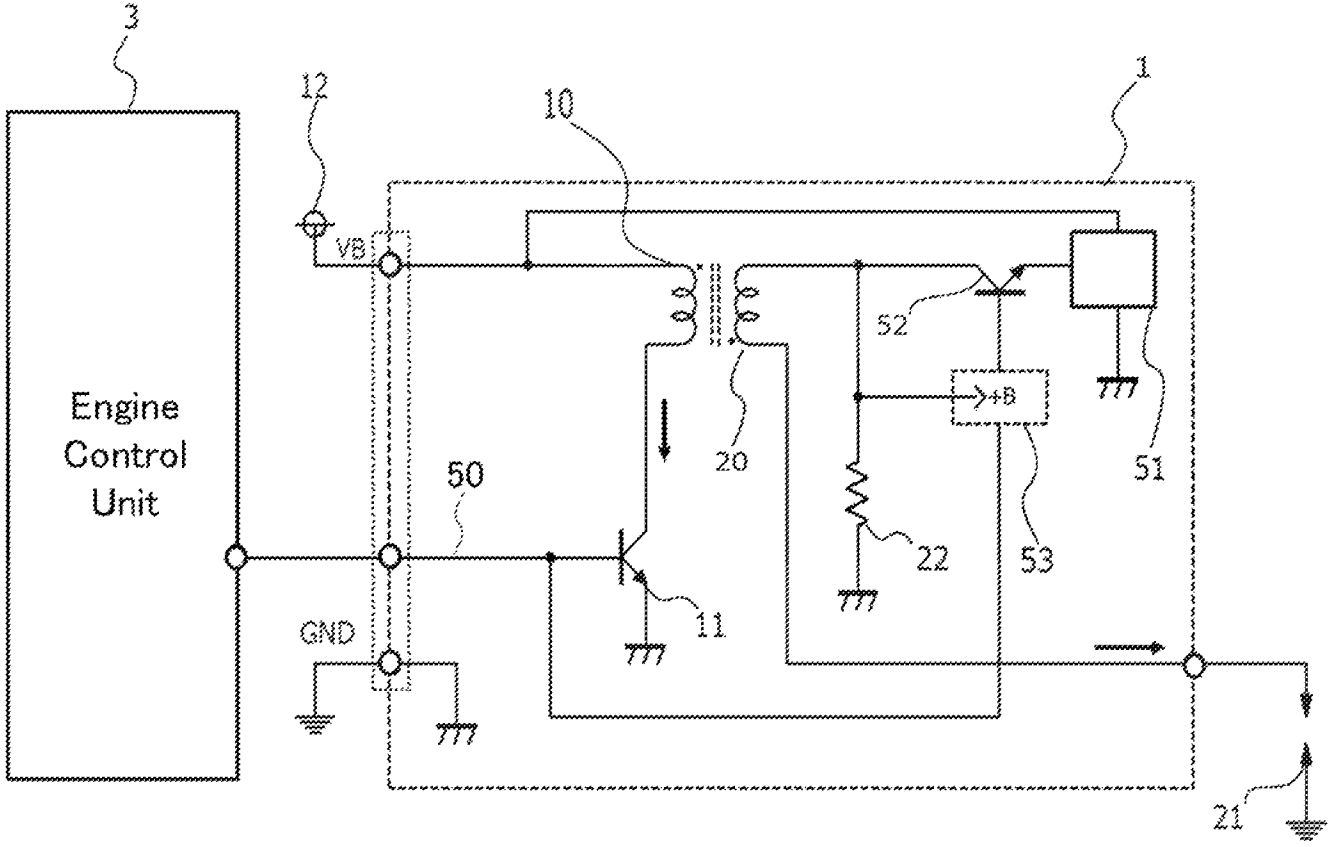
FIG. 5 is a circuit diagram of the internal combustion engine use ignition device in accordance with Embodiment 3 of the present application.
Figure 6:
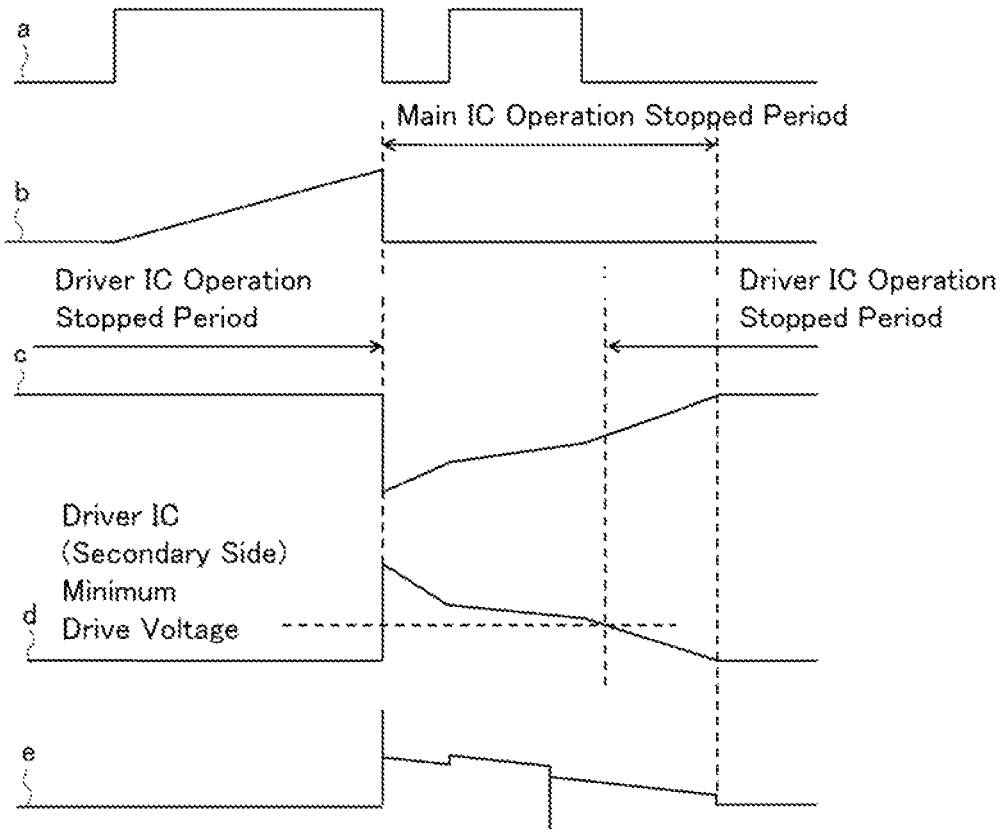
FIG. 6 is a drawing which shows the operational waveforms of the circuit diagram of FIG. 5.

FIG. 5 is a circuit diagram showing the internal combustion engine use ignition device in accordance with Embodiment 3 of the present application. Further, FIG. 6 is a drawing for showing operational waveforms in the circuit diagram of FIG. 5, where the circuit is under basic conditions.

As shown in FIG. 5, the internal combustion engine use ignition device in accordance with Embodiment 3 is provided with a main primary coil 10; a main IC 11 which is connected to the main primary coil 10, and has functions to switch between the power feeding to the main primary coil 10 and its shut off, and to detect between its own c and e terminals (the collector and the emitter), and to stop its own operation at the time when a voltage is generated between the c and e terminals; a secondary side step up power source 51 which performs a step up operation using a VB voltage; a secondary coil 20 which is connected to the ignition plug 21 at one end, and is connected to the secondary current pathway resistance 22 at the other end, and generates a discharge energy by coupling magnetically with the main primary coil 10; a secondary side switch element 52 which is disposed in parallel with the secondary current pathway resistance 22 with respect to this secondary coil 20, and switches the application of a voltage to the secondary coil 20, from the secondary side step up power source 51; and a secondary side driver IC 53 which performs a signal input to the secondary side switch element 52.

One end of the secondary current pathway resistance 22 is connected to the ground (GND), and the other end is connected to the low voltage side of the secondary coil 20 and the power source (+B) terminal of the primary side driver IC 43. For the reason above, only during the period when a secondary current is generated, electric power is supplied to the secondary side driver IC 53, so as to establish a state in which the secondary side driver can operate.

Next, operations of this circuit will be explained based on FIG. 5.

The waveform a, which is shown in FIG. 5, represents a common driving signal to the main IC 11 and the secondary side driver IC 53; the waveform b represents a current which flows into the main primary coil 10 (main primary coil current); the waveform c represents a secondary current (a current which flows into the secondary coil 20); the waveform d represents a power source voltage of the secondary side driver IC 53; and the waveform e represents a voltage between the c and e terminals (the collector and the emitter) of the main IC 11.

Following the first time on and off of the common driving signal to the main IC 11 and the secondary side driver IC 53, the power feeding to the main primary coil 10 or its shut off is carried out. In those situations, the application of a voltage is not performed to the power source (+B) terminal of the secondary side driver IC 53, and thereby, the secondary side switch element 52 is not turned on and the power feeding is not carried out to the secondary coil 20. Since the current to the main primary coil 10 is shut off, the mutual induction action is induced, and thereby, a large voltage of a negative side is generated in the secondary coil 20 (not shown in FIG. 4). With this voltage, a discharge is generated between the gaps of the ignition plug 21, and a negative current flows into the secondary coil 20 (the arrow direction of FIG. 3 is a positive direction).

Further, when power feeding by applied electric current is carried out to the secondary coil 20, a positive voltage on the basis of the ground (GND) is generated between the both terminals of the secondary current pathway resistance 22, and the voltage is applied to the power source (+B) terminal of the secondary side driver IC 53. Next, following the second time on and off of a main IC 11 & secondary side driver IC 53 common driving signal, the secondary side switch element 52 is turned on, and thereby, electric power feeding is carried out from the secondary side step up power source 51 to the secondary coil 20 which is under the power feeding of a secondary current, and then, a superimposed current is generated on the secondary current. In the case where a secondary current is generated, a voltage is generated between the c and e terminals (the collector and the emitter) of the main IC 11, and thereby, the main IC 11 stops its own operation and the power feeding to the main primary coil 10 is not carried out.

As described above, a voltage is not applied to the power source (+B) terminal of the driver IC (secondary side) 53 during the operation period of the main IC 11, and then, the operation of the secondary side driver IC 53 is stopped.

Further, the operation of the main IC 11 is stopped during the operation period of the secondary side driver IC 53, using the function to stop its own operation by detecting a voltage between the c and e terminals (the collector and the emitter) of the main IC 11. As a result, even though a driving signal in common (main IC 11 & secondary side driver IC 53 common driving signal) is input to both of the main IC 11 and the secondary side driver IC 53, a current with a positive direction starts to flow into the main primary coil 10 at the on-timing of the main IC 11, and then, the ignition operation can be performed normally.

Further, since the driving signal of the main IC 11 and the driving signal of the secondary side driver IC 53 can be both input with one signal line 50, the number of signal lines can be reduced by one, rather than inputting a driving signal into both of the main IC 11 and the secondary side driver IC 53 individually. The terminals of the ignition circuit input connector 2 can be reduced in number, and the reduced size and cost reduction can be performed in the ignition circuit 1. Further, also in the engine control unit 3 which performs signal output to the ignition circuit 1, the number of signal lines for outputting can be reduced by one, in each of the cylinders, and then, a reduced size and cost reduction can be performed.

Embodiment 4

Figure 7:
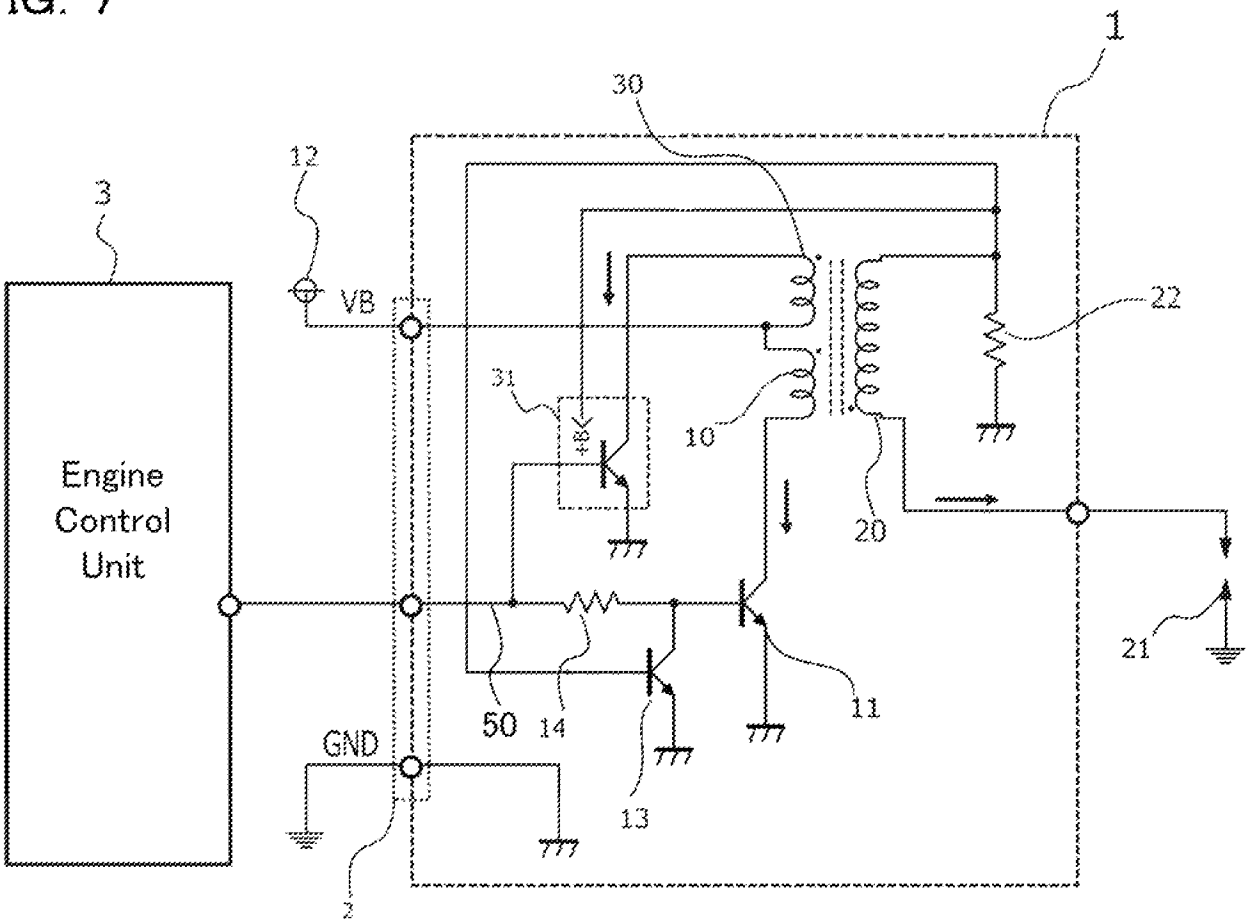
FIG. 7 is a circuit diagram of the internal combustion engine use ignition device in accordance with Embodiment 4 of the present application.

FIG. 7 is a circuit diagram which shows the internal combustion engine use ignition device, in accordance with Embodiment 4 of the present application. Further, FIG. 8 is a drawing for showing operational waveforms in the circuit diagram of FIG. 7, where the circuit is under basic conditions.

As shown in FIG. 7, in the internal combustion engine use ignition device in accordance with Embodiment 4, a main IC gate transistor 13 and a main IC gate resistance 14 are inserted at the gate of the main IC 11. Other configurations are the same as those of Embodiment 1. In Embodiment 1, the main IC 11 was connected to the main primary coil 10, and had functions to detect a voltage between its own c and e terminals (the collector and the emitter), and to stop its own operation at the time when a voltage is generated between the c and e terminals. In contrast, according these configurations in this Embodiment 4, the main IC 11 does not have the functions to detect its own voltage between the c and e terminals (the collector and the emitter), and to stop its own operation at the time when a voltage is generated.

Next, operations of this circuit will be explained based on FIG. 8.

Figure 8:
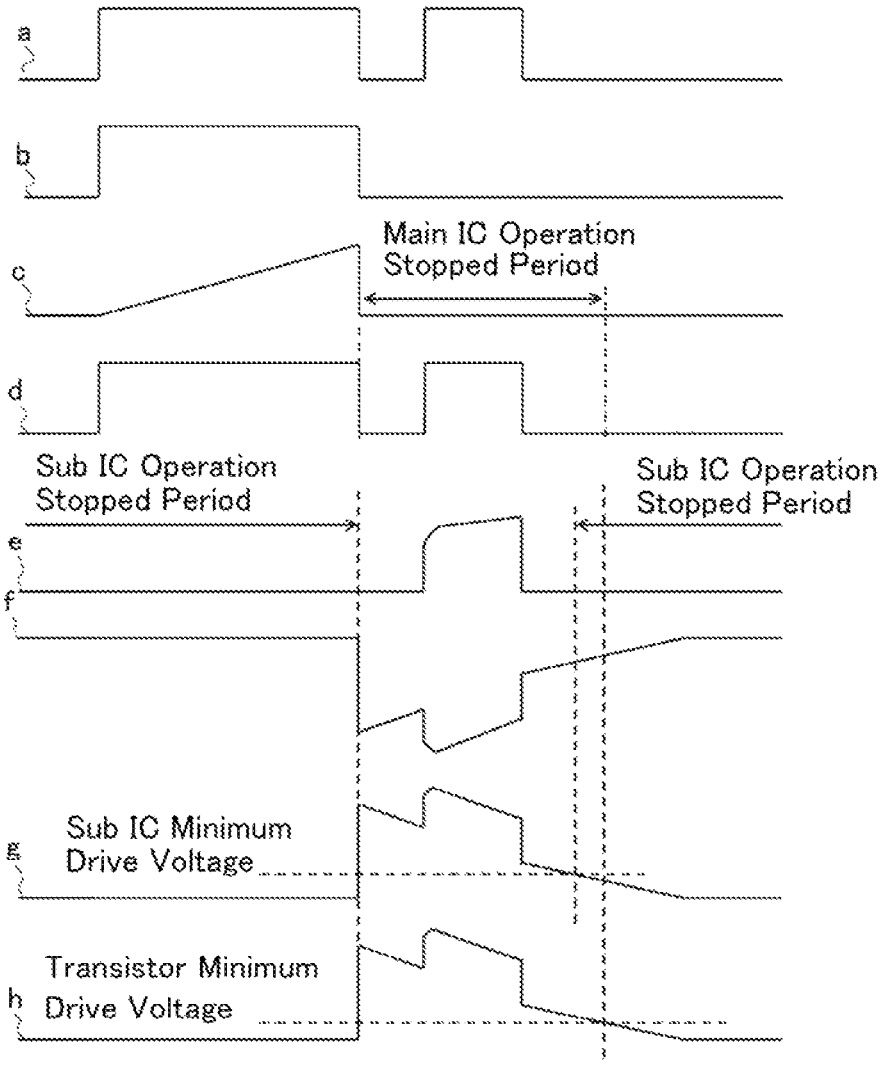
FIG. 8 is a drawing which shows the operational waveforms of the circuit diagram of FIG. 7.

The waveform a, which is shown in FIG. 8, represents a common driving signal to the main IC 11 and the sub IC 31; the waveform b represents a driving signal which is input into the main IC 11; the waveform c represents a current which flows into the main primary coil 10 (main primary coil current); the waveform d represents a driving signal which is input into the sub IC 31; the waveform e represents a current which flows into the sub primary coil 30 (sub primary coil current); the waveform f represents a secondary current (=a secondary current by the main coil+a superimposed current by the sub coil); the waveform g represents a power source voltage of the sub IC 31, and the waveform h represents a transistor driving signal which is input into the gate of the main IC gate transistor 13.

In the present Embodiment 4, when power feeding by applied electric current is carried out to the secondary coil 20, a positive voltage on the basis of the ground (GND) is generated between the both terminals of the secondary current pathway resistance 22, and a transistor driving signal is input into the gate of the main IC gate transistor 13. For the reason above, the driving signal which is input into the main IC 11 becomes a signal input of Low level, during the generation period of the secondary current, and thus, power feeding is not carried out to the main primary coil. Further, a main IC gate resistance 14 is disposed, so that the level of the driving signal which is input into the sub IC 31 may not become Low, during the period when the main IC gate transistor 13 is turned on.

As described above, even though the main IC 11 does not have the functions to detect its own voltage between the c and e terminals (the collector and the emitter), and to stop its own operation at the time when a voltage is generated, the driving signal which is input to the main IC 11 is made to become Low in level, by the main IC gate transistor 13, during the generation period of the secondary current, and thereby, the operation of the main IC 11 can be stopped during the operation of the sub IC 31. As a result, even though a driving signal in common (common driving signals to the main IC 11 and the sub IC 31) is input to both of the main IC 11 and the sub IC 31, the main primary coil 10 and the sub primary coil 30 can operate each other, without cancelling the mutual energy during their operations.

Embodiment 5

Figure 9:
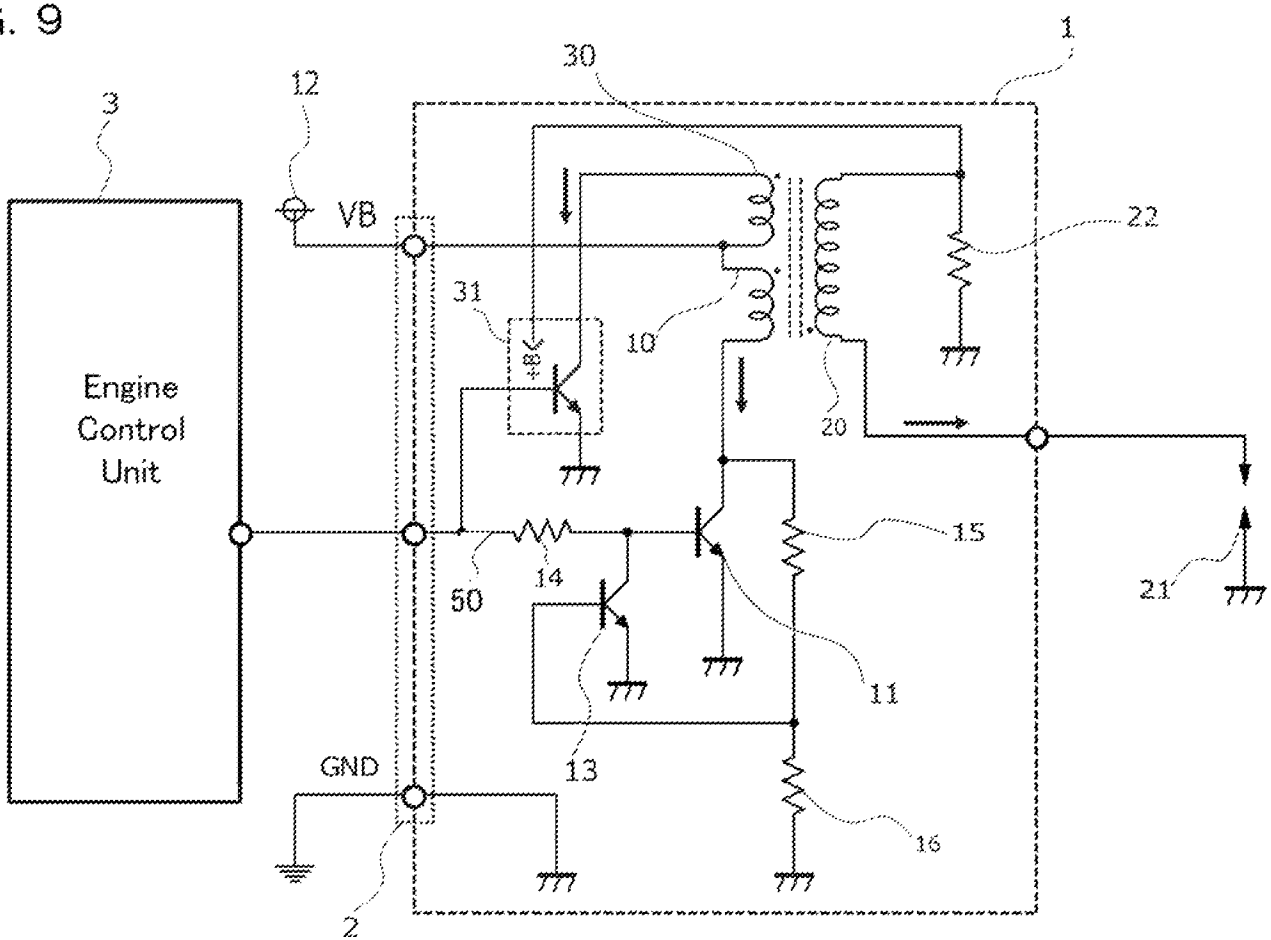
FIG. 9 is a circuit diagram of the internal combustion engine use ignition device in accordance with Embodiment 5 of the present application.
Figure 10:
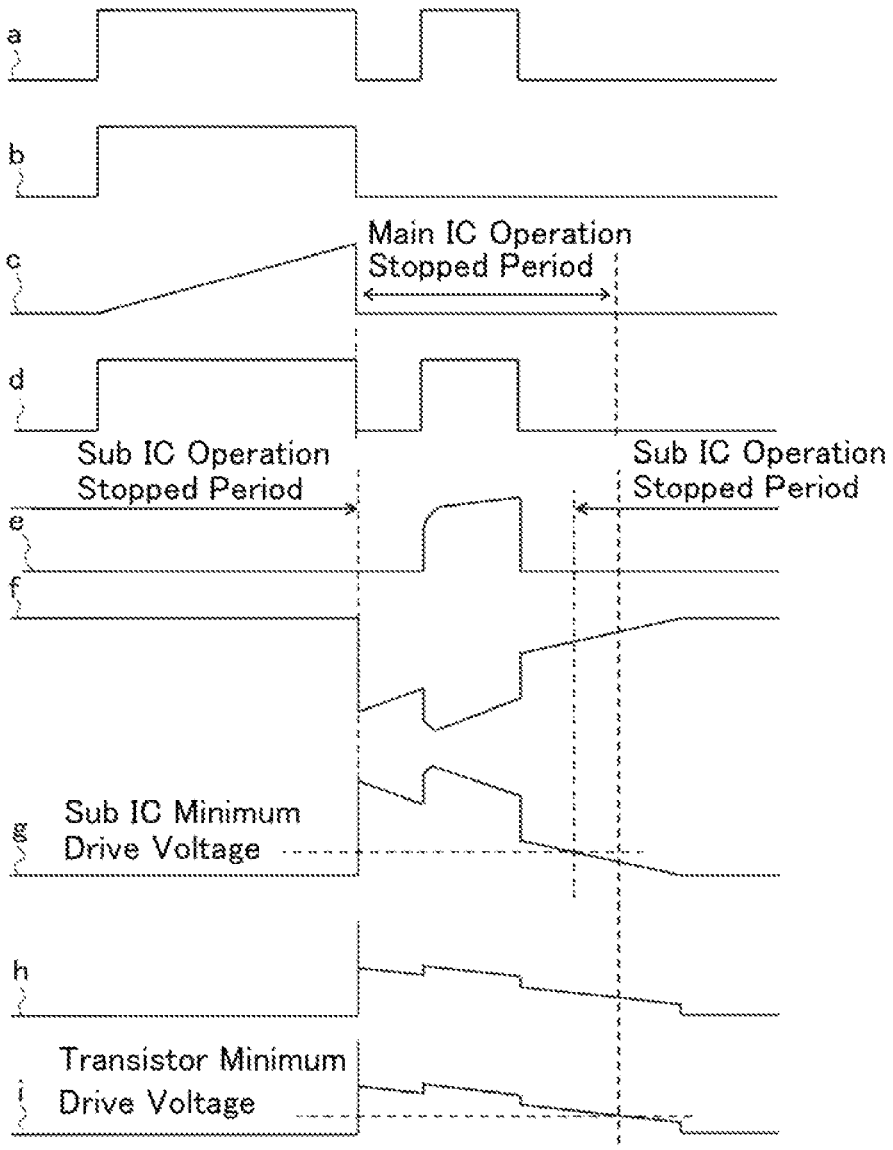
FIG. 10 is a drawing which shows the operational waveforms of the circuit diagram of FIG. 9.

FIG. 9 is a circuit diagram which shows the internal combustion engine use ignition device, in accordance with Embodiment 5 of the present application. Further, FIG. 10 is a drawing for showing operational waveforms in the circuit diagram of FIG. 9, where the circuit is under basic conditions.

As shown in FIG. 9, in the internal combustion engine use ignition device in accordance with Embodiment 5, the input of a driving signal to the main IC gate transistor 13 is not performed from the secondary current pathway resistance 22. In contrast with Embodiment 4, the collector voltage of the main IC 11 is divided with a high voltage side voltage dividing resistance 15 and a GND side voltage dividing resistance 16, and the voltage obtained here is used as a drive signal input to the main IC gate transistor 13.

According to the present Embodiment 5, when power feeding by applied electric current is carried out to the secondary coil 20, a voltage is generated between the c and e terminals (the collector and the emitter) of the main IC 11. This voltage is voltage-divided with the high voltage side voltage dividing resistance 15 and the GND side voltage dividing resistance 16, and a transistor driving signal, which is shown in FIG. 10, is input into the gate of the main IC gate transistor 13. For the reason above, during the generation period of the secondary current, the driving signal which is input into the main IC 11 becomes a signal input of Low level, and power feeding is not carried out to the main primary coil.

Next, operations of this circuit will be explained based on FIG. 10.

The waveform a, which is shown in FIG. 10, represents a common driving signal to the main IC 11 and the sub IC 31; the waveform b represents a driving signal which is input into the main IC 11; the waveform c represents a current which flows into the main primary coil 10 (main primary coil current); the waveform d represents a driving signal which is input into the sub IC 31; the waveform e represents a current which flows into the sub primary coil 30 (sub primary coil current); the waveform f represents a secondary current (=a secondary current by the main coil+a superimposed current by the sub coil); the waveform g represents a power source voltage of the sub IC 31; the waveform h represents a voltage which is generated between the c and e terminals (the collector and the emitter) of the main IC 11, and the waveform i represents a transistor driving signal which is input into the gate of the main IC gate transistor 13.

As described above, the driving signal which is input to the main IC 11 is made to become Low in level, during the generation period of the secondary current, and thereby, the operation of the main IC 11 can be stopped during the operation of the sub IC 31.

As a result, even though a driving signal in common (common driving signal to the main IC 11 and the sub IC 31) is input into both of the main IC 11 and the sub IC 31, the main primary coil 10 and the sub primary coil 30 can operate each other, without cancelling the mutual energy during their operations.

Although the present application is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments. It is therefore understood that numerous modifications which have not been exemplified can be devised without departing from the scope of the present application. For example, at least one of the constituent components may be modified, added, or eliminated. At least one of the constituent components mentioned in at least one of the preferred embodiments may be selected and combined with the constituent components mentioned in another preferred embodiment.

EXPLANATION OF NUMERALS AND SYMBOLS

1 Ignition circuit
2 Ignition circuit input connector
3 Engine control unit
10 Main primary coil
11 Main IC
12 Ignition coil power source
13 Main IC gate transistor
14 Main IC gate resistance
15 High voltage side voltage dividing resistance
16 Ground (GND) side voltage dividing resistance
20 Secondary coil
21 Ignition plug
22 Secondary current pathway resistance
30 Sub primary coil
31 Sub IC
41 Primary side step up power source
42 Primary side switch element
43 Primary side driver IC
50 Signal line
51 Secondary side step up power source
52 Secondary side switch element
53 Secondary side driver IC

What is claimed is:

1. An ignition device, comprising:

an ignition coil which has a primary coil and a secondary coil, which are wound around a core;

a superimpose circuit which generates an output energy, which is to be superimposed with respect to a secondary current of the secondary coil, produced by a first current flowing in the primary coil;

a first switch element which is connected to the primary coil and, based on a first driving signal on a common input terminal, turns on or off a current to the primary coil;

a secondary current pathway resistance which is disposed on a pathway of the secondary current and generates a voltage, when the secondary current is produced, a second switch element which is connected to the superimpose circuit and, based on a second driving signal on the common input terminal, turns on or off a current to the superimpose circuit, in response to an operation of the first switch element; and the common input terminal, wherein the common input terminal receives the first driving signal for driving the first switch element and the second driving signal for driving the second switch element, wherein an operation of the second switch element is stopped during an operation of the first switch element, the second switch element is turned on by the voltage generated in the secondary current pathway resistance, and an operation of the first switch element is stopped during an operation of the second switch element.

2. The ignition device according to claim 1, wherein the primary coil is divided into a first primary coil and a second primary coil, and the second primary coil is the superimpose circuit.

3. The ignition device according to claim 1, wherein the superimpose circuit is a step up power source which is provided at a primary coil side of the ignition coil, and the second switch element is a switch element which performs a switching in an application of a voltage to the primary coil from the step up power source.

4. The ignition device according to claim 1, wherein the superimpose circuit is a step up power source which is provided at a secondary coil side of the ignition coil, and the second switch element is a switch element which performs a switching of an application of a voltage to the secondary coil from the step up power source.

5. An internal combustion engine use ignition device, comprising:

an ignition coil which has a primary coil and a secondary coil, which are wound around a core, a superimpose circuit which generates an output energy, which is to be superimposed with respect to a secondary current, produced in the secondary coil by the primary coil, a first switch element which is connected to the primary coil and turns on or off a current to the primary coil, a second switch element which is connected to the superimpose circuit and turns on or off a current to the superimpose circuit, in response to an operation of the first switch element, and a common input terminal which receives a first driving signal for driving the first switch element and a second driving signal for driving the second switch element, wherein an operation of the second switch element is stopped during an operation of the first switch element, and an operation of the first switch element is stopped during an operation of the second switch element, wherein the primary coil is divided into a first primary coil and a second primary coil, and the second primary coil is the superimpose circuit, wherein the first switch element is connected to a signal line, and the ignition device comprises a third switch element which stops a drive of the first switch element, by employing a voltage as a power source, where the voltage is generated in a resistance which is disposed on a power feeding pathway of the secondary current.

6. The internal combustion engine use ignition device according to claim 2, wherein the first switch element is connected to a signal line, and the ignition device comprises a third switch element which stops a drive of the first switch element, by employing a voltage as a power source, where the voltage is generated in a resistance which is disposed on a power feeding pathway of the secondary current.

7. An ignition device comprising:

an ignition coil which has a primary coil and a secondary coil, which are wound around a core;

a superimpose circuit which generates an output energy, which is to be superimposed with respect to a secondary current of the secondary coil, produced by a first current flowing in the primary coil;

a first switch element which is connected to the primary coil and turns on or off a current to the primary coil;

a secondary current pathway resistance which is disposed on a pathway of the secondary current and generates a voltage, when the secondary current is produced, a second switch element which is connected to the superimpose circuit and turns on or off a current to the superimpose circuit, in response to an operation of the first switch element; and a common input terminal which receives a first driving signal for driving the first switch element and a second driving signal for driving the second switch element, wherein an operation of the second switch element is stopped during an operation of the first switch element, the second switch element is turned on by the voltage generated in the secondary current pathway resistance, and an operation of the first switch element is stopped during an operation of the second switch element, and wherein the primary coil is divided into a first primary coil and a second primary coil, and the second primary coil is the superimpose circuit.

* * * * *